US009716358B1

(12) United States Patent
Hartmann, Jr. et al.

(10) Patent No.: US 9,716,358 B1
(45) Date of Patent: Jul. 25, 2017

(54) POWER DISTRIBUTION OUTLET

(71) Applicant: ITC Incorporated, Holland, MI (US)

(72) Inventors: Richard Hartmann, Jr., Holland, MI (US); Edward Schneider, Grandville, MI (US)

(73) Assignee: ITC Incorporated, Holland, MI (US)

( * ) Notice: Subject to any disclaimer, the term of this patent is extended or adjusted under 35 U.S.C. 154(b) by 0 days.

(21) Appl. No.: 15/006,457

(22) Filed: Jan. 26, 2016

(51) Int. Cl.
*H01R 25/00* (2006.01)
*H01R 25/14* (2006.01)

(52) U.S. Cl.
CPC ..... *H01R 25/145* (2013.01)

(58) Field of Classification Search
CPC .... H01R 25/14; H01R 25/145; H01R 13/514; H01R 25/4534; H01R 25/006; H01R 25/003
See application file for complete search history.

(56) References Cited

U.S. PATENT DOCUMENTS 6,220,880 B1 * 4/2001 Lee ..... H01R 25/003 439/214
6,491,535 B1 * 12/2002 Buse ..... H02G 3/00 174/480
7,052,299 B2 * 5/2006 Kim ..... H01R 13/70 439/211
7,128,585 B2 * 10/2006 Evilsizer ..... H01R 25/14 439/120
7,575,470 B2 * 8/2009 Pyrros ..... H01R 13/514 439/535
8,491,343 B2 * 7/2013 Wang ..... H01R 25/006 439/640
9,325,129 B2 * 4/2016 Soneda ..... H01R 25/003
2012/0149221 A1 * 6/2012 Huang ..... H01R 13/4534 439/137
2016/0286697 A1 * 9/2016 Degen ..... H01R 13/53

* cited by examiner

*Primary Examiner* — Jean F Duverne
(74) *Attorney, Agent, or Firm* — Varnum, Riddering, Schmidt & Howlett LLP

(57) ABSTRACT

A linear power distribution outlet is generally presented. The power distribution outlet includes a housing having at least one side including an opening therein. An insert may be positioned within the housing and formed of an electrically insulating material. The insert may comprise a first slot, second slide and a dividing wall between the first and second slots. The first and second slots may be accessible through the opening in the housing. A first power distribution rail may extend along a length of the insert. The first power distribution rail may be positioned to be exposed to and accessible to the first slot. A second power distribution rail may extend along a length of the insert and may be positioned to be exposed to and accessible to the second slot. The first and second slots may be uniquely shaped and the first and second power distribution rails may be positioned to prevent reverse polarity connections.

19 Claims, 7 Drawing Sheets

POWER DISTRIBUTION OUTLET

FIELD OF INVENTION

The present invention relates to a power supply system and more specifically to a system and method for variable positioning power supply attachment.

BACKGROUND

Low voltage devices, such as LED strip lighting, are commonly used in both retail and other consumer environments. For example, in retail environments, merchandise is commonly displayed on a series of adjustable shelves. The shelves may be moved and adjusted based on the merchandise that is displayed on them. One common challenge with displaying merchandise on shelves is providing adequate lighting. When displayed products are not properly lit they may appear less appealing or to consumers.

Low voltage lighting, such as LED strip lighting, is commonly used to illuminate retail products on shelves. A common lighting challenge with any shelving and display lighting is to provide a power connection to the lighting at every position along the adjustable range. Typical power connections provide discreet power connections for a plug. While some power strips provide a plurality of connection locations, the options are still limited to discreet locations on the strip.

In addition, any power distribution solution for DC lighting and devices faces additional design challenges. Specifically, DC devices require a specific polarity, while AC devices may be plugged in with the plug prongs in any orientation. If the prongs of a DC device are reversed, the reverse flow of current may damage the device or render it unworkable.

Accordingly, an improved power connection method and device are need in the industry.

SUMMARY

A power distribution outlet is generally presented. The linear power distribution outlet includes a housing having a plurality of sides and at least one side including an opening therein. An insert may be positioned within the housing. The insert may be formed of an electrically insulating material. The insert may comprise a first slot, second slide and a dividing wall between the first and second slots. The first and second slots may be positioned to be accessible through the opening in the housing.

A first power distribution rail may extend along a length of the insert. The first power distribution rail may be positioned to be exposed to and accessible to the first slot. A second power distribution rail may extend along a length of the insert and may be positioned to be exposed to and accessible to the second slot.

In an embodiment, the second slot may be longer than the first slot.

In an embodiment the second slit may be wider than the first slot.

In an embodiment, a plug may be configured to integrate with the power distribution outlet. The plug may comprise a first prong and a second prong. The second prong may be longer than the first prong. The second prong may be wider than the first prong. The first and second prongs may each include an indentation positioned, sized, and shaped to correspond to the first and second power distribution rails respectively. The first and second power distribution rails may be positioned offset to each engage the indentation on the corresponding prong.

BRIEF DESCRIPTION OF THE DRAWINGS

The operation of the invention may be better understood by reference to the detailed description taken in connection with the following illustrations, wherein.

DETAILED DESCRIPTION

Reference will now be made in detail to exemplary embodiments of the present invention, examples of which are illustrated in the accompanying drawings. It is to be understood that other embodiments may be utilized and structural and functional changes may be made without departing from the respective scope of the invention. Moreover, features of the various embodiments may be combined or altered without departing from the scope of the invention. As such, the following description is presented by way of illustration only and should not limit in any way the various alternatives and modifications that may be made to the illustrated embodiments and still be within the spirit and scope of the invention.

A power distribution outlet 10 is generally presented. The power distribution outlet 10 may be configured to provide a powered connection, such as a low voltage power connection, at variable or continuous locations along its length.

Figure 1:
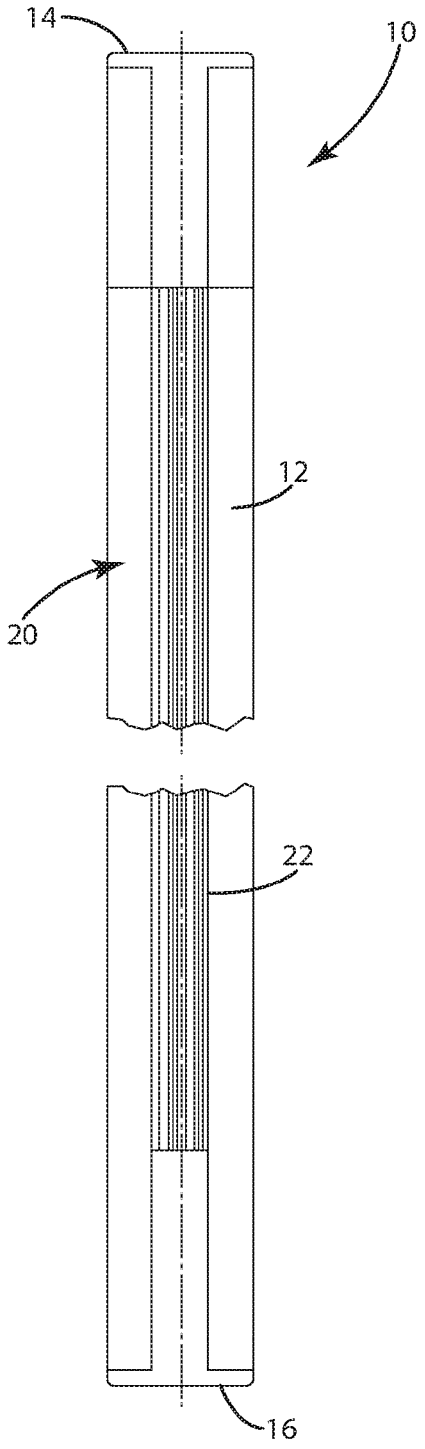
FIG. 1 illustrates a front view of a continuous power distribution outlet.
Figure 2:
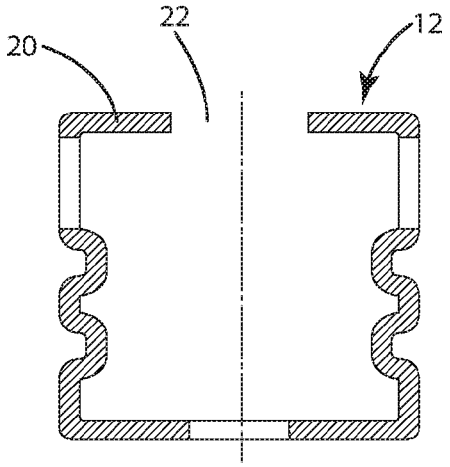
FIG. 2 is a top, cross-sectional view of a power distribution outlet housing.

The power distribution outlet 10 may include a housing 12. The housing 12 may generally comprise a plurality of sides arranged to form an enclosure. As illustrated in FIGS. 1 and 2, the housing may include four sides and form an enclosure having a square cross-section. However, it will be appreciated that the housing may be formed in any appropriate shape or configuration.

The housing 12 may extend for a length between a first end 14 and a second end 16. The housing enclosure may define a volume therein to house components for the power distribution outlet 10, as described in further detail below.

The housing 12 may be comprised of any appropriate material. In an embodiment, the housing 12 may be formed of aluminum, such as extruded aluminum. The housing 12 may include various indentations, grooves, and/or openings therein to facilitate connection to any appropriate structure or device.

A side of the housing 12, such as a front side 20, includes an opening 22. The opening 22 may extend for a portion of the length of the housing 12, as shown in FIG. 1, or may extend up to the entire length of the housing 12 between the first and second ends 14, 16. The opening 22 may comprise a slot, such as a generally rectangular slot, centered along the face of the front side 20. The opening 22 may be sized and shaped to receive a power plug therein. Specifically, the opening 22 may have a width that is wider than the width of the prongs on a corresponding power plug.

The power distribution outlet 10 may include an insert 30. The insert 30 may be formed of any appropriate material, preferably an electrically insulating material such as plastic. The insert 30 may be positioned within the housing enclosure 12 and configured to be fixed with respect to the housing 12. In an embodiment, the insert 30 may include one or more legs 32. The legs 32 may engage or abut interior geometries of the housing 12 to provide a friction fit and hold the insert 30 in place within the housing 12. The insert 30 may extend along the length of the housing 12 for at least the length of the opening 22.

The insert 30 may include a first slot 34 and a second slot 36. For low voltage DC applications, the first slot 34 may correspond to the supply voltage connection and the second slot 36 may correspond to the return voltage connection. The slots 34, 36 may be defined by walls formed in the insert 30. The walls may be arranged and positioned such that the slots 34, 36 align with the opening 22 to allow a plug to be inserted therein.

The first slot 34 may be defined between a first sidewall 38 positioned near a first edge of the opening 22 and a center wall 40 positioned near the center of the opening 22. The first slot 34 may extend for a first depth into the insert 30 and may have a first width between the first sidewall 38 and the center wall 40. The first slot 34 may extend along the length or a portion of the length of the insert 30 and may be accessible from outside the power distribution outlet 10 through the opening 22.

The second slot 36 may be defined between a second sidewall 42, opposite the first sidewall 38 positioned near a second edge of the opening 22, and the center wall 40. The second slot 36 may extend for a second depth into the insert 30 and may comprise a second width between the second sidewall 42 and the center wall 40. The depth of the second slot 36 may be greater than the first depth of the first slot 34 and may extend a further distance from the front wall 20 of the housing 12. The width of the second slot 36 may be greater than the first slot 34. The second slot 36 may extend along the length or a portion of the length of the insert 30 and may be accessible from outside the power distribution outlet 10 through the opening 22.

Figure 3:
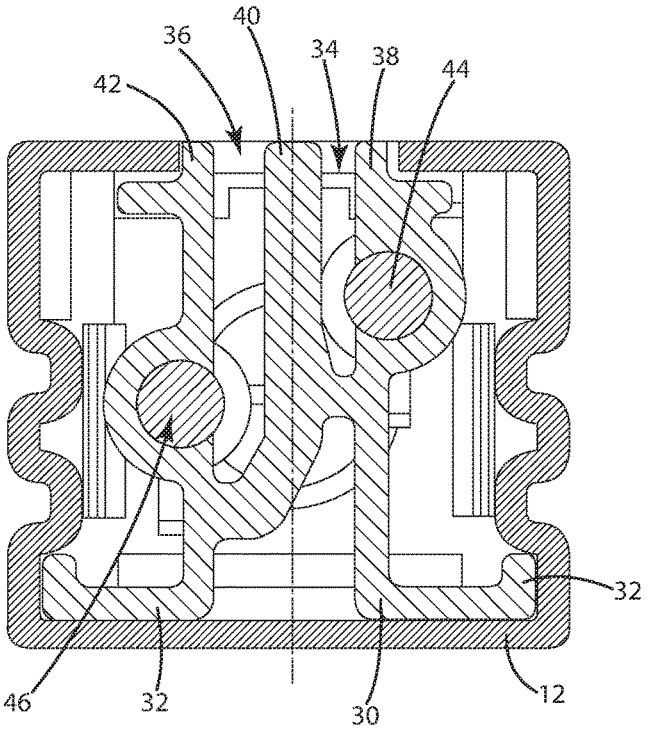
FIG. 3 illustrates a top, cutaway view of a continuous power distribution outlet.

A first power rail 44 may be positioned within the insert 30 and accessible to the first slot 34. The first power distribution rail 44 may be formed out of any appropriate electrically conductive material, such as copper. The first power rail 44 may be any appropriate size and shape, such as having a generally circular cross section as illustrated in FIG. 3. The first power rail 44 may be connected to a source voltage, such as described in further detail below. The first power rail 44 may extend along the length of the slot 34 to provide a power connection to a plug inserted into the slot 34 at any point along its length.

In an embodiment, the first power rail 44 may be adjacent to or embedded in the first sidewall 38. As illustrated in FIG. 3, the first power rail 44 may be cylindrical and mostly surrounded by the first sidewall 38, such as partially molded therein. At least a portion of the first power rail 44 will be exposed to the slot and may jut out from the sidewall 38 to be within the slot 34. As illustrated in the FIGS, the exposed portion of the first power rail 44 may form a semi-circular protrusion away from the sidewall 38. This arrangement will ensure contact between the first power rail 44 and a plug prong inserted into the slot 34.

A second power rail 46 may be positioned within the insert 30 and accessible to the second slot 36. The second power distribution rail 46 may be formed out of any appropriate electrically conductive material, such as copper. The second power rail 46 may be any appropriate size and shape, such as having a generally circular cross section as illustrated in FIG. 3. The second power rail 46 may be connected to a return voltage, such as described in further detail below. The second power rail 46 may extend along the slot 36 to provide a power connection to a plug inserted into the slot 36 at any point along its length.

In an embodiment, the second power rail 46 may be adjacent to or embedded in the second sidewall 42. As illustrated in FIG. 3, the second power rail 46 may be cylindrical and mostly surrounded by the second sidewall 42, such as partially molded therein. At least a portion of the second power rail 46 will be exposed and may jut out from the sidewall 42 to be accessible within the slot 36. As illustrated in the FIGS, the exposed portion of the second power rail 46 may form a semi-circular protrusion away from the sidewall 42. This arrangement will ensure contact between the second power rail 46 and a plug prong inserted into the slot 36

In an embodiment, the first and second power rails 44, 46 may be offset at different depths within their respective slots 34, 36. For example, as illustrated in FIG. 3, the first power rail 44 may be positioned to contact a prong at a first depth within the slot 34. The second power rail 46 may be located deeper into the second slot 36 to contact a prong at a greater depth in the slot 36. This arrangement may insure that the appropriate prong on a power plug contacts the appropriate power rail 44, 46.

The power distribution outlet 10 may be arranged to receive a connection at one or both ends 14, 16. The connection may be any appropriate connection, such as a power connection. For example, as illustrated in FIGS. 4-7, the power distribution outlet may include a female connector positioned at its end. The female connector may be any appropriate connector, such as a barrel connector 50. The power rails 44, 46 may be connected to the contacts of the connector 50. The connector 50 may be configured to receive power from a connection, such as a corresponding male connector. The male connector may be connected back to a power source, such as a UL Class 2 low voltage power supply.

In an embodiment, the power distribution outlet 10 may include a standard connector or connection component at one or both ends 14, 16. For example, the outlet 10 may include a USB connector, a passive infrared (PIR) connector, a power switch, or any other standard connector configured to receive a power connection. Alternatively, the outlet 10 may include a hardwired pigtail to allow the power to be supplied directly from a hardwired connection.

Figure 4:
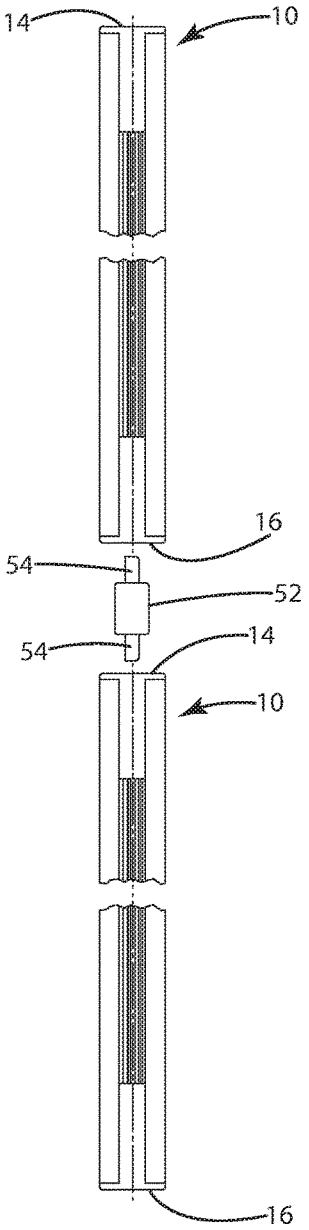
FIG. 4 illustrates an interconnection between a first continuous power strip and a second continuous power distribution outlet.
Figure 5:
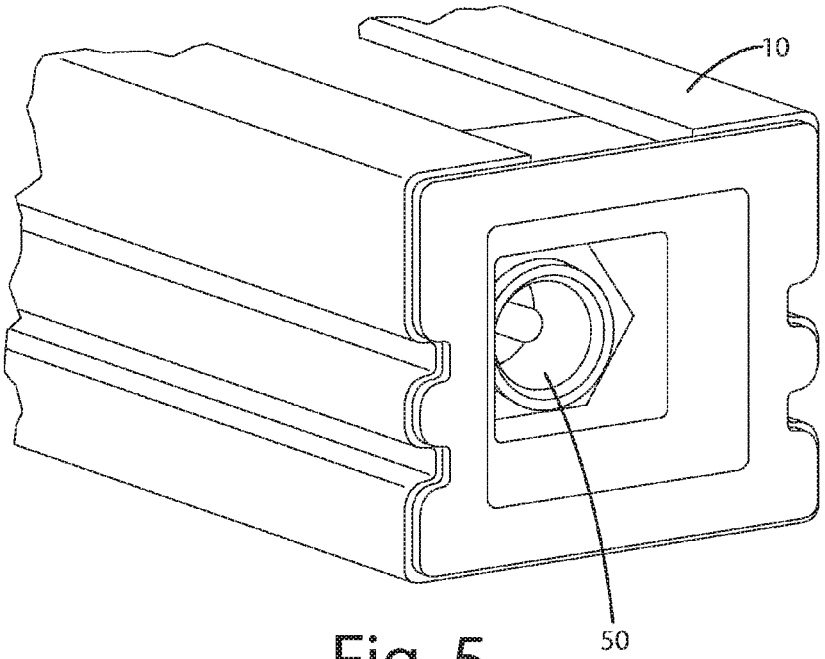
FIG. 5 illustrates a bottom connector of a continuous power distribution outlet.
Figure 6:
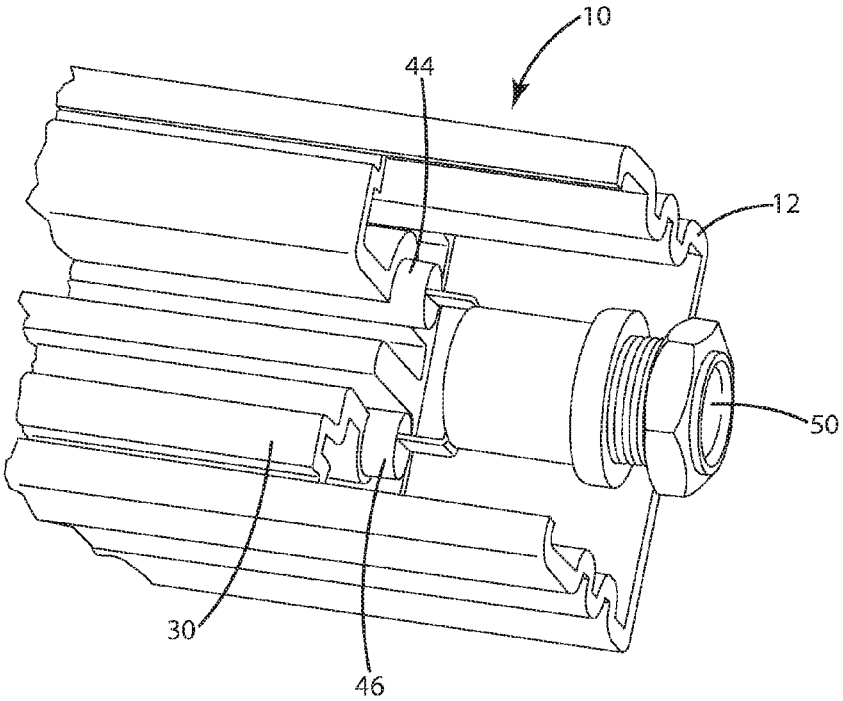
FIG. 6 illustrates a cutaway view of a bottom connector of a continuous power distribution outlet.
Figure 7:
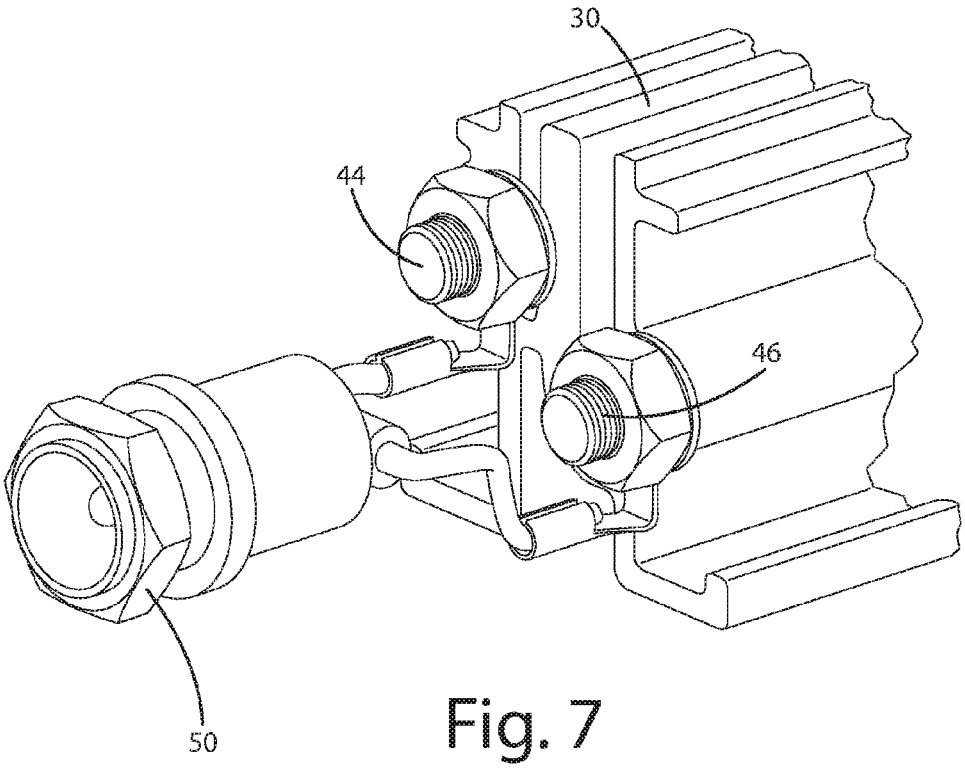
FIG. 7 illustrates an insert member connected to a bottom connector of a continuous power distribution outlet.
Figure 8:
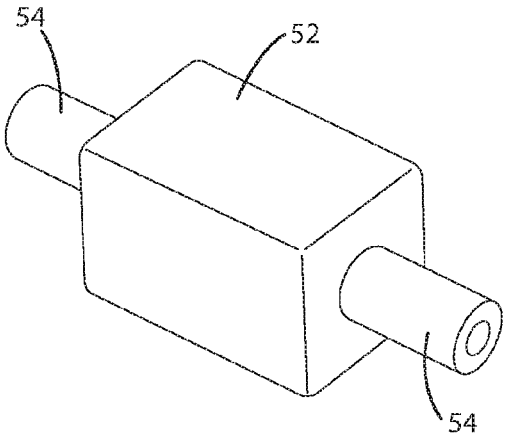
FIG. 8 illustrates a power outlet barrel connector plug.

The power distribution outlet 10 may be interconnectable and stackable with other power distribution outlets 10. For example, as illustrated in FIG. 4, a first power distribution outlet 10 may be connected to a second power distribution outlet 10 via an adaptor 52. The adaptor 52 may include a male connector 54 at each end to interconnect the two power distribution outlets 10. This may allow the power distribution outlets 10 to be both stackable and scalable.

In an embodiment, the adapter 52 may include internal components and electronics configured to modify or optimize the power connection or the interconnection of a first distribution outlet 10 to a second distribution outlet 10. For example, the adapter 52 may include electronics or circuitry configured to monitor, modify, or control the power signal passed between distribution outlets 10. The circuitry may be specifically designed to regulate or measure power, prevent an over current or over voltage condition, or even pass a data signal between distribution outlets 10.

In an embodiment, the adapter 52 may be shaped to join a first outlet 10 with one or more outlets 10. For example, the adapter 52 may include a first connection to connect to a first power distribution outlet 10 and two or more additional connections to connect to additional power distribution outlets 10. The connections may be arranged in any appropriate configuration, such as a T-shaped configuration to connect two power distribution outlets 10 approximately perpendicular to a first power distribution outlet 10, or a Y-shaped configuration to connect two power distribution outlets 10 at an angle with respect to a first power distribution outlet 10, or any other appropriate arrangement.

Figure 9:
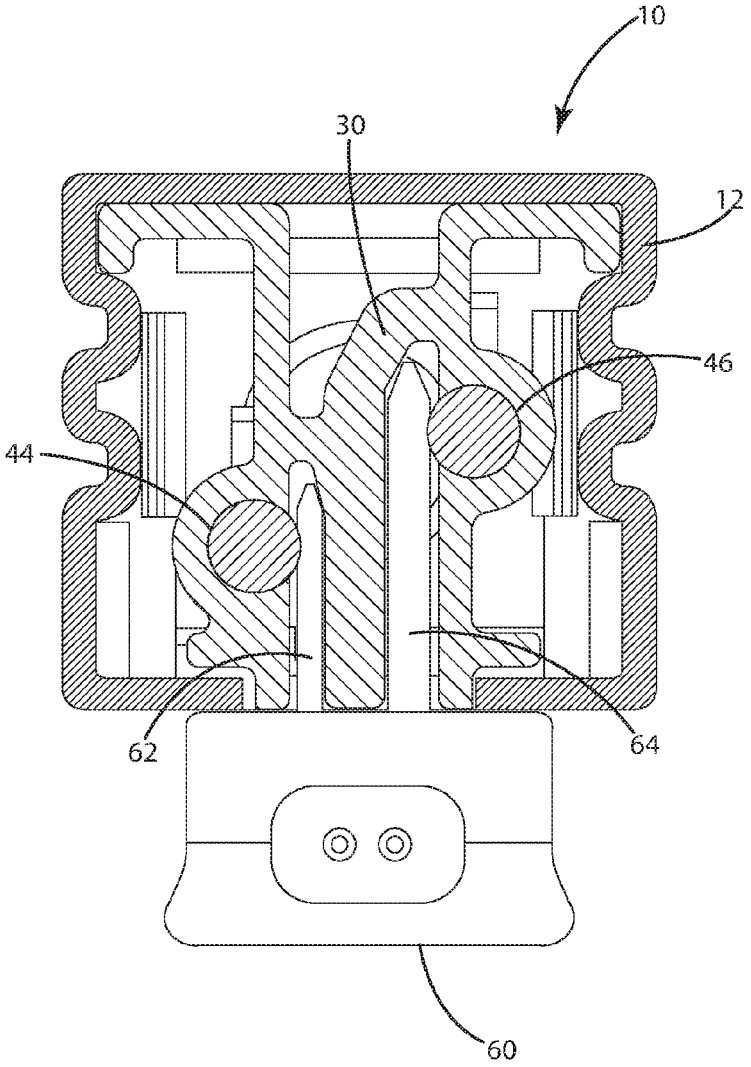
FIG. 9 illustrates a top cutaway view of a continuous power distribution outlet having a plug inserted therein.
Figure 10A:
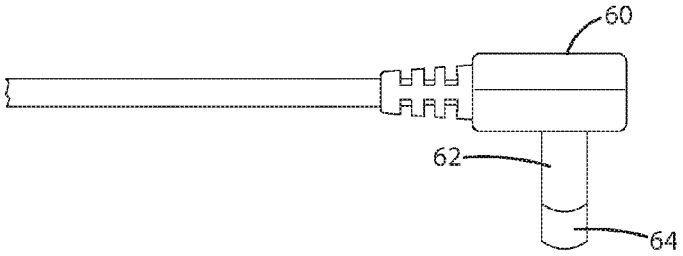
FIG. 10*a* illustrates a side view of a power plug for a continuous power distribution outlet.
Figure 10B:
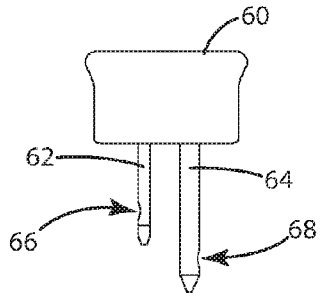
FIG. 10*b* illustrates a side view of a power plug for a continuous power distribution outlet.
Figure 11:
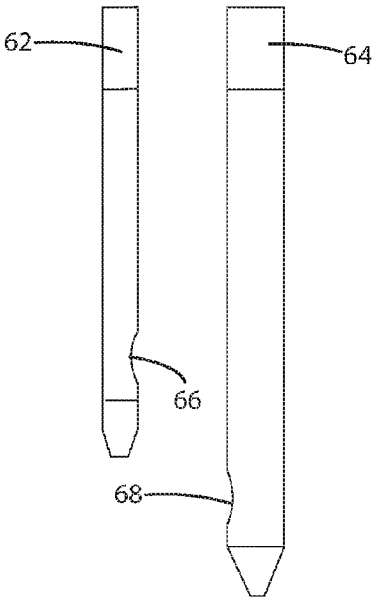
FIG. 11 illustrates the left and right conductors of a power plug for a continuous power distribution outlet.

The power distribution outlet 10 may be configured to integrate with a proprietary plug. As illustrated in FIGS. 9-11, the plug 60 may be specifically designed to engage and connect to the power distribution outlet 10 while protecting against a reverse polarity connection.

The plug 60 may include a first prong 62 and a second prong 64. The first prong 62 may be shorter than the second prong 64 and configured to engage the first rail 44. The first prong 62 may be long enough to contact the first power rail 44 when the plug 60 is fully inserted into the opening 22 but not long enough to reach the second power rail 46 when inserted with the wrong orientation.

The first prong 62 may include a first indentation 66 configured to engage with the protrusion of the first power rail 44. For example, when the plug 60 is fully inserted into the opening 22, the first indentation 66 may align with and engage the first power rail protrusion. The indentation 66 may be semi-circular in shape to form to the protrusion. It will be appreciated, however, that the protrusion and indentation 66 may be any appropriate size and shape to align and connect. The protrusion and indentation 66 may lock the prong 62 into place and ensure an adequate engagement between the power rail 44 and the prong 62.

The second prong 64 may be longer than the first prong 62 and configured to reach and engage the second rail 46. When inserted into the first slot 34, however, the second prong 64 may be too long to allow the plug 60 to be fully inserted into the opening 22 and may bottom out before the base of the plug 60 is flush with the housing 12. The second prong 64 may be wider than the first prong 62 and sized and shaped to fit only in the second slot 36. Specifically, the second prong 64 may be wider than the first slot 34 to prevent the second prong 64 from being inserted into the first slot 34.

The second prong 64 may include a second indentation 68 configured to engage with the protrusion of the second power rail 46. For example, when the plug 60 is fully inserted into the opening 22, the second indentation 68 may align with and engage the second power rail protrusion. The indentation 68 may be semi-circular in shape to form to the protrusion. It will be appreciated, however, that the protrusion and indentation 68 may be any appropriate size and shape to align and connect. The protrusion and indentation 68 may lock the prong 64 into place and ensure an adequate engagement between the power rail 46 and the prong 64.

Figure 12:
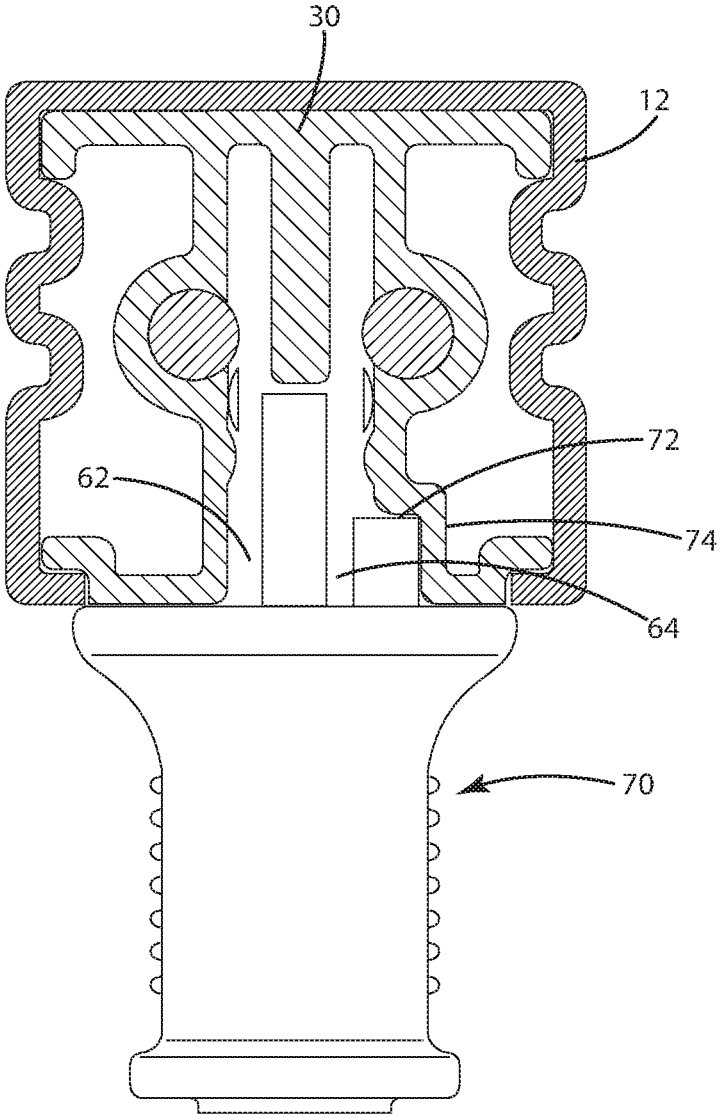
FIG. 12 illustrates a top cutaway view of an embodiment of a power plug inserted into a continuous power distribution outlet.

In an embodiment, a plug 70 may include additional features to ensure the correct polarity orientation. As illustrated in FIG. 12, the plug 70 may include a protuberance 72 extending from the base of the plug body 70. The protuberance 72 may be configured to align with and engage a similarly shaped dimple 74 in the insert 30. The protuberance 72 may be located on only once side of the plug thereby only allowing one connection orientation and preventing a reverse polarity connection.

Although the embodiments of the present invention have been illustrated in the accompanying drawings and described in the foregoing detailed description, it is to be understood that the present invention is not to be limited to just the embodiments disclosed, but that the invention described herein is capable of numerous rearrangements, modifications and substitutions without departing from the scope of the claims hereafter. The claims as follows are intended to include all modifications and alterations insofar as they come within the scope of the claims or the equivalent thereof.

Having thus described the invention, we claim:

1. A power distribution outlet comprising:

a housing including a front face and a plurality of sides and having a length, wherein the front face includes an opening therein, the opening extending along at least a portion of the length;

an insert positioned within the housing and formed of an insulating material, the insert comprising:

a first slot positioned accessible to the opening;

a second slot positioned accessible to the opening; and a dividing wall between the first and second slots;

a first power distribution rail extending along a length of the insert, the first power distribution rail comprising a rod at least partially surrounded by the insert and having an exposed curved portion exposed along its length and accessible to one side of the first slot;

a second power distribution rail electrically isolated from the first distribution rail and extending along a length of the insulation insert, the second power distribution rail comprising a rod at least partially surrounded by the insert and having an exposed curved portion exposed along its length and accessible to one side of accessible to the second slot;

wherein the first power distribution rail is positioned a first distance away from the front face, and the second power distribution rail is positioned a second distance away from the front face, greater than the first distance.

2. The power distribution outlet of claim 1, wherein the insert is formed of electrically insulating material.

3. The power distribution outlet of claim 1, wherein the first and second power distribution rails are at least partially molded into the insert.

4. The power distribution outlet of claim 1, wherein the second slot is wider than the first slot.

5. The power distribution outlet of claim 1, wherein the second slot is deeper than the first slot.

6. The power distribution outlet of claim 1, wherein the insert comprises a first sidewall, center wall, and second sidewall, and further wherein the first slot is formed between the first sidewall and the center wall, and the second slot is formed between the second sidewall and the center wall.

7. The power distribution outlet of claim 6, wherein the first power rail is formed into the first sidewall.

8. The power distribution outlet of claim 1, wherein the first and second power distribution rails are cylindrical.

9. A power distribution system comprising:

a housing including a front face and a plurality of sides and having a length, wherein the front face includes an opening therein, the opening extending along at least a portion of the length;

an insert positioned within the housing, the insert comprising:

a first slot positioned accessible to the opening;

a second slot positioned accessible to the opening; and a dividing wall between the first and second slots;

a first power distribution rail extending along a length of the insert, the first distribution rail accessible to one side of the first slot;

a second power distribution rail electrically isolated from the first distribution rail and extending along a length of the insulation insert, the second distribution rail accessible to one side of the second slot;

wherein the first power distribution rail is positioned a first distance away from the front face, and the second power distribution rail is positioned a second distance away from the front face, greater than the first distance; and a plug configured to engage the first and second power distribution rails through the opening, the plug comprising a first prong and a second prong, wherein the first prong is shorter than the second prong.

10. The power distribution system of claim 9, wherein the second power distribution rail is positioned further from the opening than the first power distribution rail.

11. The power distribution system of claim 9, wherein the insert comprises a first sidewall, center wall, and second sidewall, and further wherein the first slot is formed between the first sidewall and the center wall, and the second slot is formed between the second sidewall and the center wall.

12. The power distribution system of claim 11, wherein the first power rail is embedded in the first sidewall and further wherein a portion of the first power rail forms a protrusion from the first sidewall.

13. The power distribution system of claim 12, wherein the first prong includes an indentation configured to engage the protrusion.

14. A power distribution system comprising:

a housing including a front face and a plurality of sides and having a length, wherein the front face includes an opening therein, the opening extending along at least a portion of the length;

an insert positioned within the housing, the insert comprising:

a first slot positioned accessible to the opening;

a second slot positioned accessible to the opening; and a dividing wall between the first and second slots;

a first power distribution rail extending along a length of the insert, the first distribution rail accessible to one side of the first slot;

a second power distribution rail electrically isolated from the first distribution rail and extending along a length of the insulation insert, the second distribution rail accessible to one side of the second slot;

wherein the first power distribution rail is positioned a first distance away from the front face, and the second power distribution rail is positioned a second distance away from the front face, greater than the first distance; and a plug configured to engage the first and second power distribution rails through the opening, the plug comprising a first prong and a second prong, wherein the second prong is wider than the first prong.

15. The power distribution system of claim 14, wherein the second slot is wider than the first slot.

16. The power distribution system of claim 14, wherein the second prong is wider than the first prong.

17. The power distribution system of claim 14, wherein the insert comprises a first sidewall, center wall, and second sidewall, and further wherein the first slot is formed between the first sidewall and the center wall, and the second slot is formed between the second sidewall and the center wall.

18. The power distribution system of claim 17, wherein the first power rail is embedded in the first sidewall and further wherein a portion of the first power rail forms a protrusion from the first sidewall.

19. The power distribution system of claim 18, wherein the first prong includes an indentation configured to engage the protrusion.

* * * * *